US006607470B2

(12) United States Patent
Catanescu et al.

(10) Patent No.: US 6,607,470 B2
(45) **Date of Patent: *Aug. 19, 2003**

(54) METHOD AND APPARATUS FOR COUPLING A WHEELCHAIR TO AN EXERCISE APPARATUS

(76) Inventors: Florea Catanescu, 8236 Holly Oak St., Citrus Heights, CA (US) 95610; Codruta Diana Ioana Catanescu, 8236 Holly Oak St., Citrus Heights, CA (US) 95610; Florela Liana Catanescu, 8236 Holly Oak St., Citrus Heights, CA (US) 95610

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/246,503

(22) Filed: Feb. 8, 1999

(65) Prior Publication Data

US 2003/0092535 A1 May 15, 2003

(30) Foreign Application Priority Data

Jul. 27, 1998 (RO) ..... 98-01220

(51) Int. Cl.[7] ..... A63B 69/16
(52) U.S. Cl. ..... 482/57; 482/60
(58) Field of Search ..... 482/51, 57, 60, 482/63, 64, 130, 142, 908

(56) References Cited

U.S. PATENT DOCUMENTS 4,222,376 A * 9/1980 Praprotnik ..... 128/25 R
4,262,902 A * 4/1981 Dranselka ..... 272/132
4,265,447 A * 5/1981 Shafer ..... 272/73
4,572,501 A * 2/1986 Durham et al. ..... 272/73
4,824,132 A * 4/1989 Moore ..... 280/304.1
4,911,435 A * 3/1990 Johns ..... 272/134
4,995,775 A * 2/1991 Gresham ..... 410/10
5,100,128 A * 3/1992 Mabry et al. ..... 482/134
5,143,391 A * 9/1992 Robertson et al. ..... 280/250.1

FOREIGN PATENT DOCUMENTS

JP 11-332918 * 5/1998 ..... A61G/5/00

* cited by examiner

*Primary Examiner*—Nicholas D. Lucchesi
*Assistant Examiner*—Tam Nguyen

(57) ABSTRACT

An exercise method using a chair-bicycle assembly allows people in wheelchairs to exercise in order to maintain and improve their health status. This method especially benefits elderly and handicapped people who are bound to a wheelchair. A wheelchair is coupled to a bicycle type assembly and the resulting assembly is rigidified using wheelchair brakes and blocking means. The wheelchair cushion can be adjusted to allow user to comfortably reach bicycle pedals during complete rotations. The chair-bicycle assembly is comprised of a wheelchair (1) that is positioned and blocked in front of a bicycle type assembly using wheelchair brakes (40). The wheelchair (1) is rigidly connected to bicycle type assembly with blockage means (4, 14,15). The wheelchair (1) includes a wheelchair seat (8) with a cushion (7) that can be adjusted and then blocked into position. The bicycle type assembly includes a main frame with two bars (10), support elements (5, 11, 13), a pedal mechanism and means (17, 18, 19, 20) for providing power drive to a bicycle wheel (16), and an indicative device (35) to monitor user's exerted effort and virtual distance.

14 Claims, 2 Drawing Sheets

METHOD AND APPARATUS FOR COUPLING A WHEELCHAIR TO AN EXERCISE APPARATUS

FIELD OF THE INVENTION

The invention relates to a new method and chair-bicycle assembly to be used for exercise aimed at maintaining and improving the health of elderly and handicapped people in wheelchairs.

BACKGROUND OF THE INVENTION

Elderly and handicapped people commonly use manual, mechanical, and electrical wheelchairs. Presently these wheelchairs are only used for sitting and transportation without having any means of medical rehabilitation for maintaining and improving a user's health through physical exercise.

Ergonomic bicycles are often used for medical purposes. These ergonomic bicycles are typically stationary exercise bicycles that we will refer to as bicycles. These bicycles have a braking system and a device indicating the effort made during exercise and are used as follows: a person sits on a bicycle saddle holding on to a handle bar and exercises his/her legs using two pedals.

The bicycles are currently used by people who can move without assistance devices and who can sit on a bicycle saddle. The disadvantage of these bicycles is that those who cannot sit on a bicycle saddle, such as the majority of elderly and handicapped people, are unable to use these bicycles because this position would be uncomfortable. Overweight and lack of balance are common conditions of elderly and handicapped people, which prevent them from using this type of bicycle.

BRIEF SUMMARY OF THE INVENTION

The exercise method and chair-bicycle assembly allows elderly and certain handicapped people who are bound to a wheelchair to exercise their legs in order to maintain or improve their health, as well as to recover from certain handicap conditions. The exercise method uses an assembly that with some modifications combines a wheelchair with a bicycle type assembly. The assembly of the two elements provides an apparatus enabling people who use wheelchairs and who cannot sit on a bicycle saddle or are not able to leave their wheelchairs to exercise their legs.

The chair-bicycle assembly is comprised of a wheelchair equipped with a shifting device that allows the wheelchair seat to be adjusted back and forth according to each user's needs. The shifting device allows the wheelchair with a cushion to be locked in a pre-determined position, according to the distance to bicycle pedals. A grooved wheel stop on each posterior support leg of the bicycle assures the fit of the front wheels of the wheelchair on these legs to prevent forward movement of the wheelchair. Hooked shaped coupling arms couple the lateral inferior bars of the wheelchair with the posterior support legs of the exercise apparatus to prevent backward movement of the wheelchair. These elements together with the braking system of the wheelchair assure a rigid connection between the wheelchair and the bicycle type assembly.

In order to adjust the handle bar of the bicycle type assembly according to each user's needs, a small telescopic device is placed on the intermediary bar of the bicycle type assembly. This telescopic device allows the user to obtain an optimal position through height and tilt adjustment of the handle bar.

A braking device acting on the wheel of the bicycle type assembly includes a plastic fabric tape which partially covers the bicycle wheel. This tape is connected with a cable through a spring. The cable is attached to a braking adjustment handle that the user can control to increase or decrease the effort applied to the pedals of bicycle type assembly. An indicative device is installed in connection with the bicycle type assembly wheel and the plastic fabric tape, allowing the indication of the effort exerted on the pedals and respectively, on the bicycle type assembly wheel.

Both posterior support legs of the bicycle type assembly are provided with adjustable knobs allowing lateral telescopic shifting. The posterior support legs have grooved wheel stops for receiving the anterior wheels of the wheelchair. The same legs also have couplings to connect the wheelchair to the bicycle type assembly through two arms.

The advantage of the chair-bicycle assembly is that it allows elderly and some handicapped people who use a wheelchair to maintain and improve their health by exercising. Also, this method and assembly allow a person using the equipment to control and set optimal conditions for exercise, in particular the exercise position and the effort to be made.

REFERENCE NUMERALS IN DRAWINGS

| | |
|---|---|
| 1. Wheelchair | 21. Protection Cap |
| 2. Lateral Inferior Bar | 22. Handle Bar |
| 3. Anterior Wheel | 23. Bicycle Handle |
| 4. Arm | 24. Intermediary Bar |
| 5. Posterior Support Bar | 25. Body of Locking Device |
| 6. Chair Platform | 26. Locking Handle |
| 7. Cushion | 27. Plastic Fabric Tape |
| 8. Wheelchair Seat | 28. Tape End Catch Device |
| 9. Shifting Device | 29. Spring |
| 10. Main Frame with Two Bars | 30. Support |
| 11. Anterior Support Bar | 31. Slot |
| 12. Adjustable Knob | 32. Cable |
| 13. Support Leg | 33. Cable End Catch Device |
| 14. Coupling to Lock Arm (4) | 34. Breaking Adjustment Handle |
| 15. Grooved Wheel Stop (3) | 35. Indicative Device |
| 16. Bicycle Wheel | 36. Cable |
| 17. Teeth Wheel | 37. Transport Handle |
| 18. Chain | 38. Bracket |
| 19. Pedal | 39. Bracket Handle |
| 20. Small Teeth Wheel | 40. Wheelchair Brake |

DETAILED DESCRIPTION OF THE INVENTION

Figure 1:
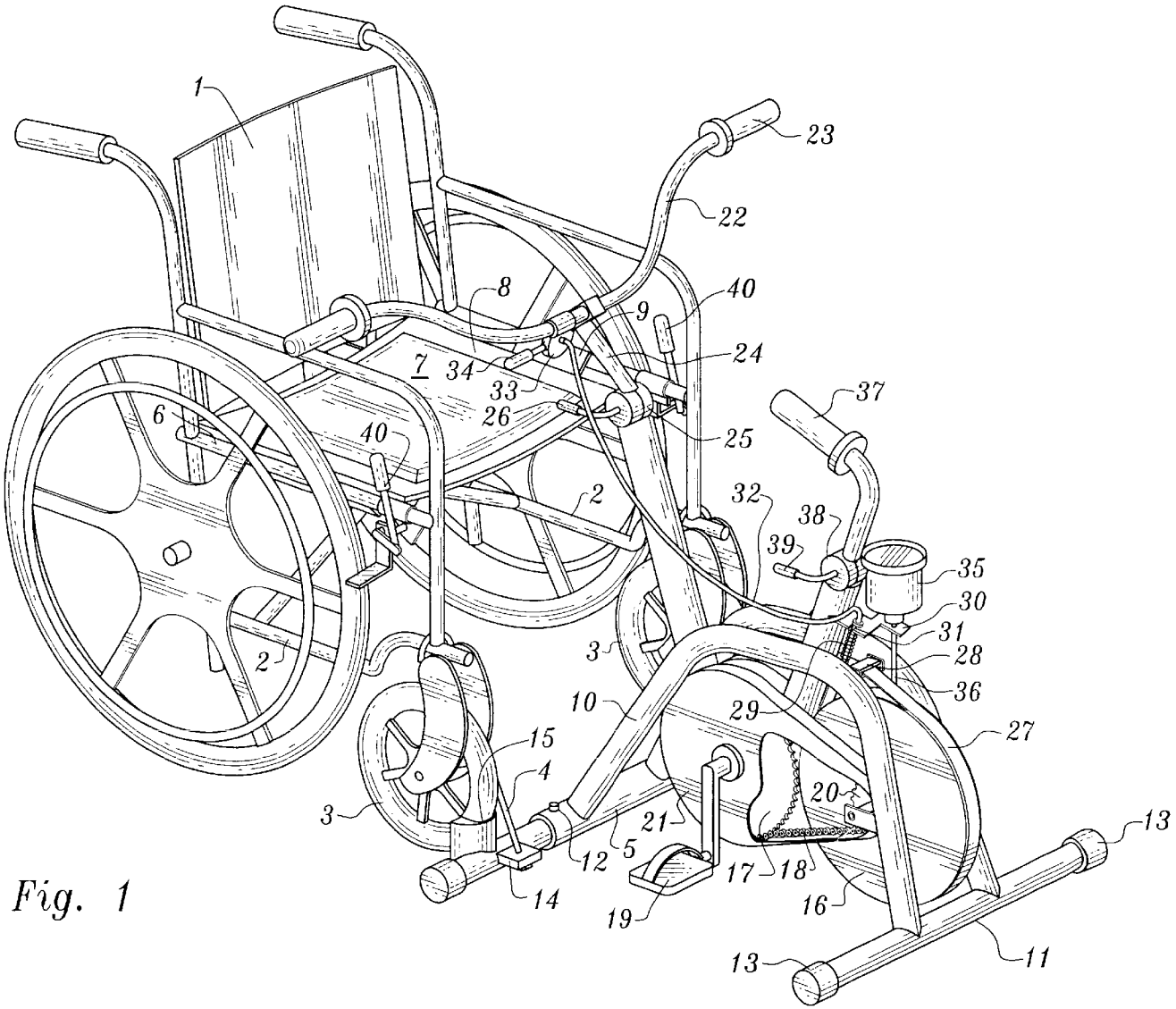
FIG. 1 shows a general view of the wheelchair-bicycle assembly.

According to the exercise method and chair-bicycle assembly a wheelchair is rigidly connected to a bicycle type assembly as shown in FIG. 1, making sure that the wheelchair and the bicycle type assembly are adjusted according to the user's needs. A user can adjust the position of the bicycle type assembly so that his/her feet can comfortably be placed on the pedals acting on the bicycle type assembly wheel. The user can also adjust the wheelchair seat to assure a comfortable position.

When the user presses their feet on the pedals, the bicycle type assembly chain transmits its movement to the bicycle type assembly wheel that rotates. During this time, the user is able to set the level of effort according to his/her capabilities and is able to modify this level at any time during the exercise to accommodate fatigue. The user can permanently monitor the level of effort on an indicative device installed on the bicycle type assembly.

The chair-bicycle assembly is comprised of a first assembly, a wheelchair 1. This wheelchair 1 has two lateral inferior bars 2 that support the anterior wheels 3 of wheelchair 1. Each lateral inferior bar 2 is provided with an arm 4 that can be rigidly connected to posterior support legs 13 of the bicycle type assembly by a coupling 14.

The user can shift back and forth a cushion 7 and a chair platform 6 of a wheelchair seat 8 by means of a shifting device 9 provided either with a sliding rail and fixing bolt or with a teeth sector and teeth wheels, and with a locking component. In this way the user can adjust his/her position in front of the bicycle type assembly.

The second assembly, a bicycle type assembly, is composed of a main frame with two bars 10 resting on two support bars— an anterior support bar 11 and a posterior support bar 5.

Figure 2:
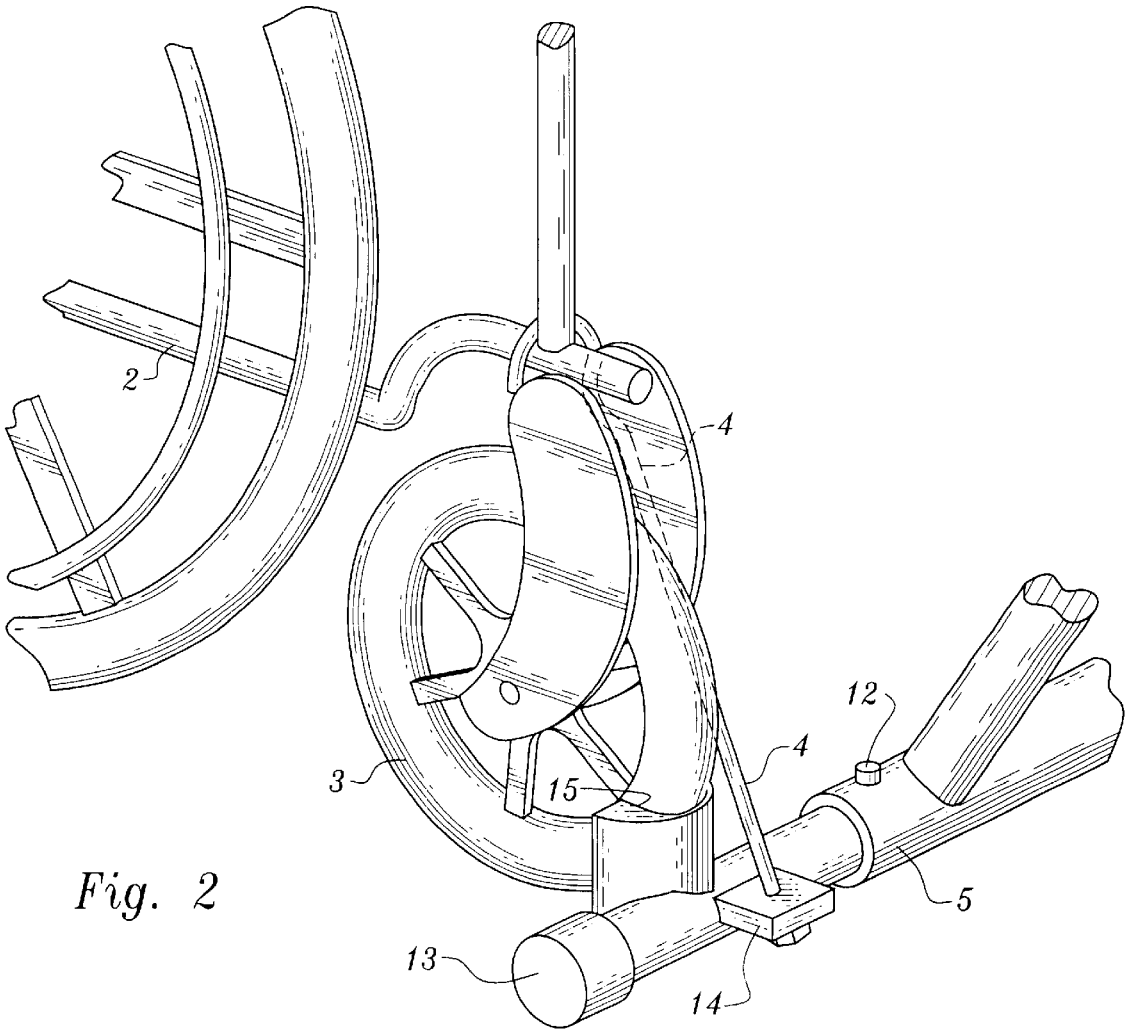
FIG. 2 shows an anterior wheelchair wheel coupled to a support leg of the bicycle type assembly of the chair-bicycle assembly.

Both anterior support bar 11 and posterior support bar 5 are telescopic, have an adjustable knob 12, and are provided with support legs 13 at their ends. Each posterior support leg 13 is provided laterally with coupling 14 to lock arms 4 of wheelchair 1 and with a grooved wheel stop 15 to lock anterior wheels 3 of wheelchair 1 as shown in FIG. 2. The main frame with two bars 10 supports a gear assembly for the rotation of a bicycle type assembly wheel 16. This gear assembly includes a teeth wheel 17, a chain 18, two pedals 19, and a small teeth wheel 20 assembled on the axle of bicycle type assembly wheel 16. Pressing on pedals 19 causes rotation of teeth wheel 17 and engagement of chain 18 that together with rotation of small teeth wheel 20 also rotates bicycle type assembly wheel 16.

The gear assembly including teeth wheel 17, chain 18, and small teeth wheel 20 is protected with a protection cap 21. In order to provide the user with some means of support during exercise, the bicycle type assembly is provided with a handle bar 22 which at both ends has a handle 23. The handle bar 22 is solidly joined with an intermediary bar 24 which is mounted on main frame 10. A body of a locking device 25 is assembled on an intermediary bar 24, allowing the user to adjust height of handle bar 22 or its tilt towards or away the user's body, according to the user's physical characteristics. Intermediary bar 24 is locked in the desired position using a locking handle 26.

In order to set the desired level of effort to be made during the exercise, the bicycle type assembly is provided with a braking assembly made of a plastic fabric tape or other similar material 27 which partially covers wheel 16. A tape end catch device 28 attaches one end of the plastic fabric tape 27 to the main frame 10.

The plastic fabric tape 27 partially covers wheel 16 while other end of plastic fabric tape is connected to a spring 29 that maintains the pressure of plastic fabric tape 27 on circumference of wheel 16. A support 30 provided with a slot 31 holds one end of spring 29. A cable 32 connects spring 29 with a cable to end catch device 33 which can be adjusted by a braking adjustment handle 34 installed on handle bar 22. An user can control the braking adjustment handle 34 to increase or decrease the pressure applied by plastic fabric tape 27 on bicycle wheel 16. In this way the effort applied on pedals 19 can be varied.

The effort made during exercise can be evaluated by an indicative device 35 installed on support 30. Indicative device 35 is actuated by a cable 36 that measures the reduction in velocity of the bicycle wheel 16 as a result of the pressure applied by plastic fabric tape 27 on bicycle wheel 16. Indicative device 35 indicates effort and virtual distance during exercise.

The bicycle type assembly is also equipped with a transport handle 37 whose height can be adjusted by tightening or loosing a bracket 38 with a bracket handle 39.

The chair-bicycle assembly for elderly and handicapped people is used as follows:

During the entire time of the exercise, the user remains seated in wheelchair 1 that must be positioned in front of the bicycle type assembly as previously described. Anterior wheels 3 of wheelchair are placed in grooved wheel stop 15 of the posterior support legs 13 of the bicycle type assembly. The bicycle type assembly is then locked and rigidly connected in this position using wheelchair brakes 40 and locking arms 4 to couple the wheelchair to the bicycle type assembly at the posterior support leg 13. In particular, the hook shaped locking arm 4 co-operates with the wheel stop 15 to prevent the wheelchair from rolling forward or backward relative to the exercise apparatus. Locking the wheelchair brakes 40 provides further restraint on relative movement between the wheelchair and the bicycle type assembly.

For a proper use of chair-bicycle assembly, the user can adjust cushion 7 of chair 8 using shifting device 9 so that the user can comfortably reach and engage the pedals throughout their complete rotation.

During entire time of exercise, the user would hold his/her hands on handles 23 of handle bar 22. In order to attain an optimal position, intermediary bar 24 and locking device 25 allow the user to adjust handle bar 22 by either lifting/lowering handle bar 22 or moving it closer/farther to chair 8. Locking handle 26 will lock handle bar 22 in desired position.

After the person starts pedaling, the effort exerted can be varied (increased/decreased) according to the user's desire, using braking adjustment handle 34 which controls the pressure applied by plastic fabric tape 27 on the circumference of bicycle type assembly wheel 16. The exercise with a variable effort will last for a predetermined length of time during which the effort can be monitored on indicative device 35.

What is claimed is:

1. A method of coupling a wheelchair to an exercise apparatus, comprising the steps of:

a) positioning a wheel of a wheelchair against a wheel stop of an exercise apparatus to prevent movement of the wheelchair toward the exercise device, wherein the wheel stop includes a groove for receiving the wheelchair wheel; and b) hooking a hook shaped locking arm of the exercise apparatus to the wheelchair, wherein the locking arm hooks the wheelchair to prevent movement of the wheelchair away from the exercise device, wherein the locking arm and the wheel stop co-operate to limit movement of the wheelchair relative to the exercise device.

2. The method of claim 1 wherein step a) further comprises the step of:

i) positioning the wheelchair such that the wheel is received at least partially within the groove of the wheel stop.

3. The method of claim 1 wherein step b) further comprises the step of:

i) hooking the hook shaped locking arm of the exercise apparatus about a lateral inferior bar of the wheelchair.

4. The method of claim 1 further comprising the step of:

c) locking the wheelchair.

5. The method of claim 1 wherein the exercise apparatus is a bicycle assembly.

6. An exercise apparatus comprising:

a wheel stop having a grooved portion for receiving a wheel of a wheelchair; and a hook shaped locking arm having a hook portion configured to be hooked about a structural member of the wheelchair, wherein the wheel stop and the hook shaped locking arm co-operate to limit movement of the wheelchair relative to the exercise apparatus.

7. The apparatus of claim 6 wherein the exercise apparatus further comprises an extendable support leg, wherein the wheel stop is coupled to the extendable support leg.

8. The apparatus of claim 6 wherein the hook shaped locking arm has one end coupled to a support leg of the exercise apparatus.

9. The apparatus of claim 6 wherein the wheel stop and the hook shaped locking arm are coupled to a same support leg of the exercise apparatus.

10. The apparatus of claim 6 wherein the support leg is extendable.

11. The apparatus of claim 6 wherein the exercise apparatus is a pedal-type exercise apparatus.

12. The apparatus of claim 6 wherein the exercise apparatus is a bicycle assembly.

13. A method of coupling a wheelchair to an exercise apparatus, comprising the steps of:

a) providing a wheel stop coupled to an exercise apparatus, wherein the wheel stop is grooved to receive a wheelchair wheel; and b) providing a hook shaped locking arm coupled to the exercise apparatus, wherein when a wheelchair wheel is received by the wheel stop and the hook shaped locking arm is hooked to the wheelchair, the hook shaped locking arm and the wheel stop co-operate to prevent forward and backward movement of the wheelchair relative to the exercise apparatus.

14. The method of claim 13, wherein the exercise apparatus is a bicycle assembly.

* * * * *